US006347456B1

(12) United States Patent
Jones et al.

(10) Patent No.: US 6,347,456 B1
(45) Date of Patent: Feb. 19, 2002

(54) FLUSH PLANE

(75) Inventors: Steve K. Jones, Nepean; Mark Summers, Sharon, both of (CA)

(73) Assignee: Lee Valley Tools, Ltd., Ottawa (CA)

( * ) Notice: Subject to any disclaimer, the term of this patent is extended or adjusted under 35 U.S.C. 154(b) by 0 days.

(21) Appl. No.: 09/494,497

(22) Filed: Jan. 31, 2000

(51) Int. Cl.[7] ..... B25G 3/00

(52) U.S. Cl. ..... 30/491; 30/478

(58) Field of Search ..... 30/151, 162, 491, 30/492, 487, 482, 478

(56) References Cited

U.S. PATENT DOCUMENTS 306,763 A * 10/1884 Laskey ..... 30/491 X
5,940,970 A * 8/1999 D'Ambro et al. ..... 30/125

* cited by examiner

*Primary Examiner*—Douglas Watts
(74) *Attorney, Agent, or Firm*—John S. Pratt, Esq.; Kristin L. Johnson, Esq.; Kilpatrick Stockton LLP

(57) ABSTRACT

A plane having an easily removable blade positionable in use flush against the work surface. A magnet attached to the underside of the handle of the plane secures the blade to the handle. The blade may be positioned on the handle with the cutting edge exposed or simply reversed to store the cutting edge of the blade under the handle.

24 Claims, 2 Drawing Sheets

FLUSH PLANE

FIELD OF THE INVENTION

This invention relates to woodworking planes and chisels.

BACKGROUND OF THE INVENTION

Planes are used in woodworking to flatten and smooth a surface. Conventional planes use blades oriented at an angle (generally between about 12° and 45°) to the sole of the plane and, therefore, to the surface being worked. The blades are mounted on the plane body, generally with screws and other devices, and protrude through a slot in the bottom of the plane to contact the work surface under the plane.

This configuration precludes quick and easy blade removal or adjustment so that the sharp edge does not project from the plane. Instead, the user must entirely remove the blade from the plane or retract the blade, both of which are time-consuming.

Moreover, some woodworking operations, such as those involving flush trimming projections such as glue lines, laminate edges and plugs, can best be accomplished with a tool having a cutting edge or arris at the end of a blade positioned very close to, or against, the surface of the workpiece. However, conventional blade mounting arrangements make it difficult to mount a plane blade at an angle lower than about twelve degrees relative to the work surface.

While in some instances it is possible to perform these operations using a bench chisel with the underside of the chisel blade resting on the work surface, at times the handle of such a chisel prevents it from being positioned close to the work surface. In those instances, a crank-necked chisel may serve, but in either case the challenge of controlling a chisel is present. A chisel plane may provide greater control, but conventional chisel planes necessarily position the blade not with the underside resting against the work surface but at an angle relative to the surface of the workpiece, which may be undesirable.

SUMMARY OF THE INVENTION

This invention addresses these problems by providing a plane having an easily removable blade oriented to rest on the work surface. The plane consists of a handle and a blade. The underside of the contoured handle is fitted with a ferromagnetic cup, containing a magnet. A blade, having a sharp end with an arris or cutting edge and a blunt opposite end, is positioned on the underside of the handle. The magnet attracts the metal blade and secures the blade to the handle. When positioned in this way, nothing projects from the handle below the bottom surface of the blade, and therefore the bottom surface of the blade acts like the sole of a conventional bench plane and rests on the work surface. This permits trimming to be accomplished flush with the work surface.

The blade may be re-positioned on the handle after rotating it 180° so that the cutting edge is protected and only the blunt end is exposed. To store the blade, the user simply breaks the magnetic attraction between the blade and magnet, reverses the blade and re-secures the blade to the magnet with the cutting edge protected on the underside of the handle. This enables the user to quickly and easily store the plane, even in a crowded tool box, without risk of injury to the user or damage to the cutting edge of the blade.

DETAILED DESCRIPTION OF THE DRAWINGS

Figure 1:
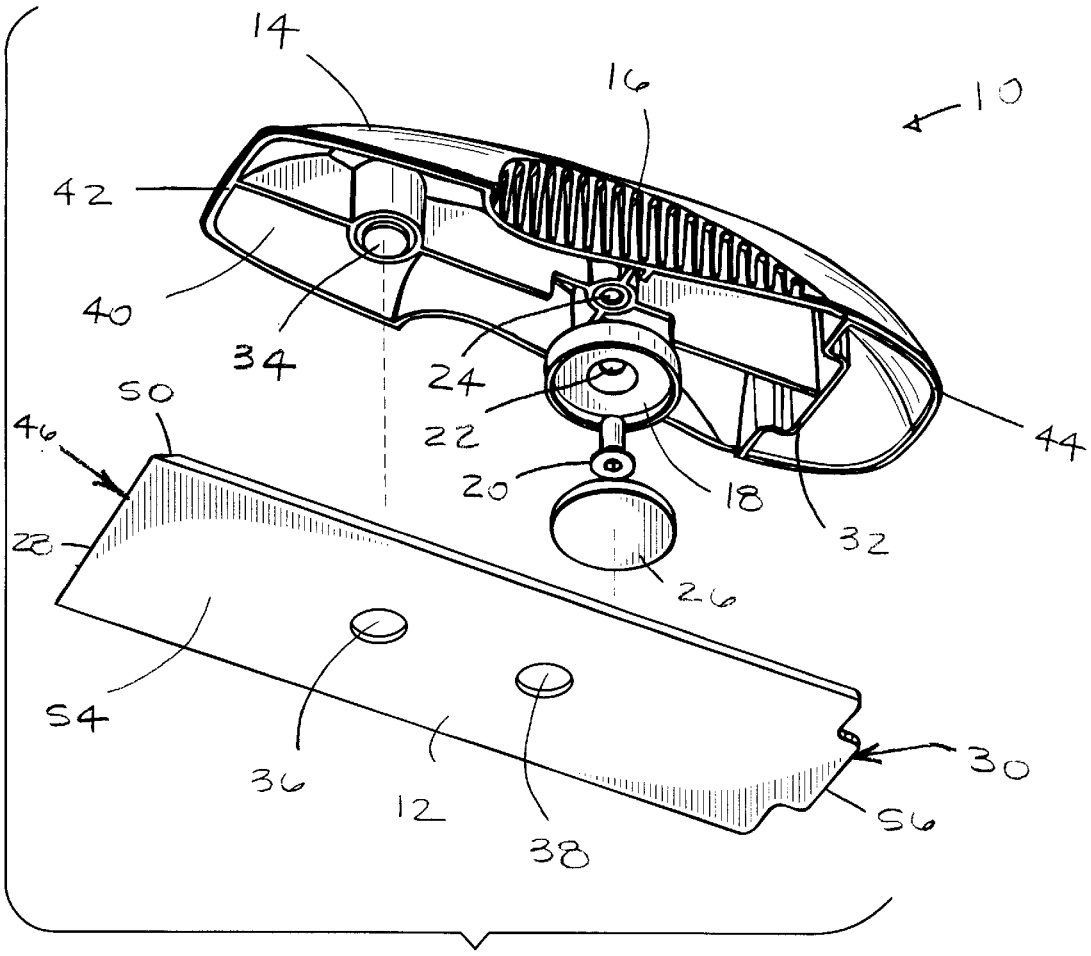
FIG. 1 is an exploded perspective view of the plane with the cutting edge of the blade exposed.

FIG. 1 illustrates one embodiment of the plane 10 of this invention. The plane 10 generally consists of a blade 12 secured to the underside of a handle 14. The preferred embodiment of plane 10 of this invention is lightweight, weighing less than 10 oz. and preferably about 8 oz. While the handle 14 may be made from a variety of materials including metals, such as cast iron, aluminum or bronze, nylon, polyvinyl chloride, or polycarbonate, it is preferably made of acrylonitrile-butadiene-styrene. The handle 14 is contoured to fit the user's hand and may include ridges 16 on the gripping surface to facilitate a comfortable, secure grip. The base 40 of the handle 14 is stepped, having a sole 42 and a heel 44.

The blade 12 can be various widths; however, a 2 inch (5 centimeter) wide blade 12 has been found to be sufficiently wide for the plane 10 to accomplish its intended function in a timely manner while still allowing the user to maneuver the plane 10 in tighter spaces or narrower areas on a working surface. The blade has two ends, a sharp end 46 and a blunt end 30. The sharp end 46 has a cutting edge or arris 28. The cutting edge 28 is formed by a bevel 50 at, for instance, a 25° bevel angle.

Blade 12 is secured to the handle 14 by magnetic attraction. To best accomplish this, a magnet cup 18 is first fastened to the base 40 of the handle 14. While any number of fastening devices can be used, the present embodiment uses a screw 20 that passes through a magnet cup hole 22 and into a handle hole 24 located on the base 40 of the handle 14. Once the magnet cup 18 is fastened to the handle 14, a magnet 26 is placed in the magnet cup 18. Magnetic attraction locks the magnet 26 in the magnet cup 18. When locked in the magnet cup 18, the magnet 26 is flush with the sole 42 of the base 40 of the handle 14.

Figure 2:
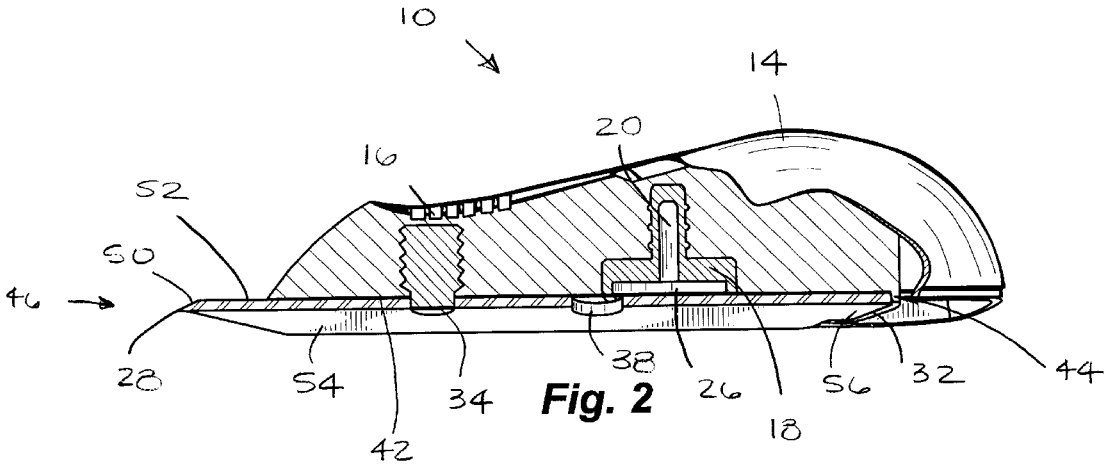
FIG. 2 is a view of one side and the bottom of the plane shown in FIG. 1 with portions of the handle and blade shown cut away.

Once the magnet 26 is in place, the blade 12 is then positioned on the handle 14 with either the cutting edge 28 exposed or stored. FIGS. 1 and 2 illustrate positioning of the blade 12 on the handle 14 with the cutting edge 28 exposed. The top face 52 of the blade 12 is positioned to rest against the sole 42 of the base 40 and thereby locks to the magnet 26. When so positioned, the blunt end 30 abuts or seats against the heel 44 of the base 40.

The blunt end 30 of the blade 12 is shaped to complement and fit in a shaped recess 32 in the base 40 of the handle 14. In the present embodiment, the shaped recess 32 is a groove into which a tongue 56 formed on the blunt end 30 of the blade 12 fits. While the illustrated embodiment uses a tongue and groove configuration, a number of alternative configurations would be equally effective to facilitate the interlocking between the blunt end 30 and the shaped recess 32 to resist forces tending to dislodge blade 12 from handle 14 during use of plane 10.

Use of the magnetic cup 18 to secure the magnet 26 to the handle 14 concentrates the magnetic flux, thereby increasing the strength at the exposed face of the magnet 14 and consequently the attraction between the blade 12 and the magnet 26. The appropriate size of the magnet naturally depends on the size of the blade, the strength of the magnet and whether a flux-concentrating cup is used. A one inch (2.5 centimeter) diameter rare earth magnet, however, securely holds a two inch (5 centimeter) wide blade in place.

In addition to the magnet 26, a pin 34 may be located on the base 40 of the handle 14 to further secure the blade 12 in the proper position on the handle 14. The pin 34 may be made from any suitably sturdy material, such as steel, and is molded in place on the handle. The pin 34, which projects no more than the thickness of the blade 12 and therefore does not protrude from the bottom face 54 of the blade 12, fits into an engagement slot 36 on the blade 12. Receipt of the pin 34 in the engagement slot 36 indicates to the user that the blade 12 is properly aligned with the handle 14. The interlock of the tongue 56 of the blunt end 30 of the blade 12 and the shaped recess 32 and the engagement of pin 34 with engagement slot 36 fix the blade 12 in place, thus preventing it from moving laterally or toward the rear of the handle 14 when the plane 10 is in use. Moreover, securing the blade 12 to the handle 14 with a magnet 26, pin 34 and interlocking tongue 56 and recess 32 results in a plane 10 with the blade secured without any projections from the bottom face 54 of the blade 12, thereby permitting the exposed bottom face 54 to serve as the sole of the plane.

Figure 3:
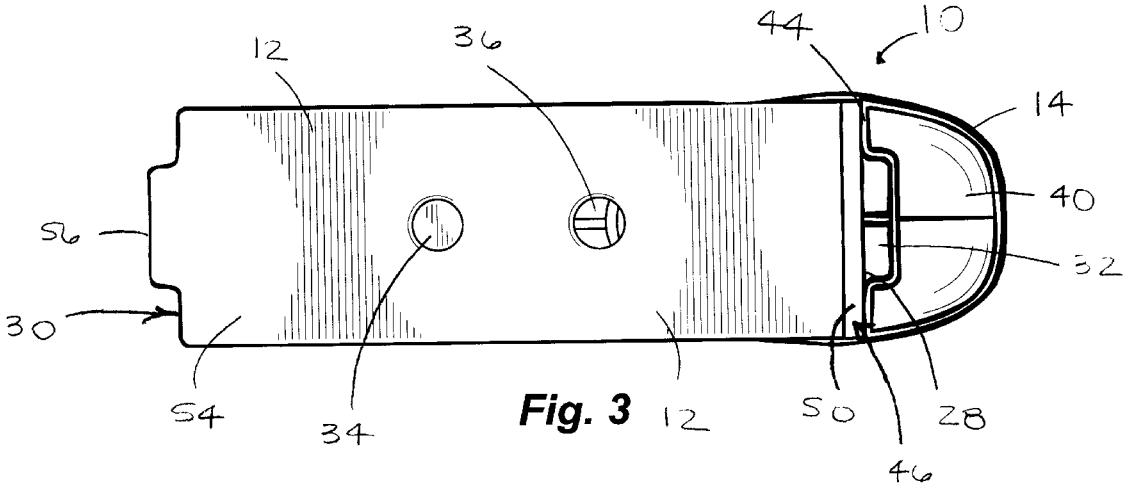
FIG. 3 is a bottom plan view of the plane shown in FIGS. 1 and 2 with the cutting edge of the blade stored.

The blade 12 can be easily reversed to protect the cutting edge 28 of the blade 12 within the base 40 of the handle 14 for protection and storage, as shown in FIG. 3. The blade 12 is removed from the handle 14 by simply breaking the magnetic attraction between the blade 12 and the magnet 14. The blade 12 is then positioned against the base 40 of the handle 14 with the cutting edge 28 stored. The blade 12 once again attaches to the magnet 26, and the pin 34 now engages the storage slot 38 located in the blade 12 to further fix the blade 12 in position.

The foregoing is provided for the purpose of illustrating, explaining and describing embodiments of the present invention. Further modifications and adaptations to these embodiments will be apparent to those skilled in the art and may be made without departing from the spirit of the invention or the scope of the following claims.

We claim:

1. A plane, comprising:

a. a handle comprising a base;

b. a blade comprising a first side and an opposed side; and c. a magnet for securing the blade to the handle during use of the plane by magnetic attraction between the magnet and the first side of the blade and without contact between any portion of the handle and the opposed side of the blade.

2. The plane of claim 1, wherein the blade further comprises a sharp end having a cutting edge.

3. The plane of claim 2, wherein the blade can be installed on the handle so that the cutting edge is either exposed for use or protected for storage.

4. The plane of claim 1, wherein the blade further comprises a blunt end.

5. The plane of claim 4, wherein the blunt end comprises a shape that is not straight.

6. The plane of claim 5, wherein the handle further comprises a recess located on the base of the handle shaped to complement the shape.

7. A plane, comprising:

a. a handle having a longitudinal axis and comprising an upper gripping surface and a base; and b. a blade attached to the base of the handle and oriented parallel to the longitudinal axis of the handle and comprising a top face, a bottom face, a blunt end, and a sharp end having a cutting edge, wherein the blade can be installed on the handle so that the cutting edge is either exposed for use or protected for storage, wherein the base of the handle is stepped and has a sole and a heel, wherein the top face of the blade rests against the sole of the base and the blunt end of the blade abuts the heel of the base when the blade is installed on the handle so that the cutting edge is exposed for use.

8. The plane of claim 1, wherein the blade is detachable from the handle.

9. The plane of claim 1, further comprising a magnet cup attached to the base of the handle for receiving the magnet.

10. The plane of claim 9, wherein the magnet cup is attached to the base with a screw.

11. The plane of claim 1, wherein the handle further comprises a pin located on the base of the handle.

12. The plane of claim 11, wherein the blade has at least one slot for receiving the pin.

13. The plane of claim 1, wherein the handle further comprises a smooth, bulbous portion for contact during use by a palm of a user's hand.

14. The plane of claim 1, wherein the handle further comprises generally vertical ridges on opposite sides of the handle for contact during use by a user's thumb and fingers.

15. A plane, comprising:

a. a handle having a longitudinal axis and comprising an upper gripping surface and a base;

b. a magnet cup attached to the handle;

c. a magnet positioned in the magnet cup; and d. a blade having a sharp end comprising a cutting arris and a blunt end, wherein the blade is attachable to the handle with the magnet so that the cutting arris is transverse to the longitudinal axis of the handle and the blade is positionable in a first position with the cutting arris exposed for use and a second position with the cutting arris protected for storage.

16. The plane of claim 15, wherein the handle comprises plastic.

17. The plane of claim 15, wherein the base comprises a pin and the blade further comprises at least one hole for receiving the pin when the blade is attached to the handle.

18. A plane, comprising:

a. a handle having a longitudinal axis and comprising an upper gripping surface and a base;

b. a magnet cup attached to the handle;

c. a magnet positioned in the magnet cup; and d. a blade having a sharp end comprising a cutting arris and a blunt end, wherein the blade is attachable to the handle with the magnet so that the cutting arris is transverse to the longitudinal axis of the handle and alternatively (i) the cutting arris protrudes from the handle or (ii) the blunt end protrudes from the handle, wherein the base comprises a pin and the blade comprises a first hole for receiving the pin when the blade is positioned with the cutting arris protruding from the handle and a second hole for receiving the pin when the blade is positioned with the blunt edge protruding from the handle.

19. The plane of claim 15, wherein the blunt end comprises a shape that is not straight.

20. A plane, comprising:

a. a handle having a longitudinal axis and comprising an upper gripping surface and a base;

b. a magnet cup attached to the handle;

c. a magnet positioned in the magnet cup; and d. a blade having a sharp end comprising a cutting arris and a blunt end comprising a shape that is not straight, wherein the blade is attachable to the handle with the magnet so that the cutting arris is transverse to the longitudinal axis of the handle and alternatively (i) the cutting arris protrudes from the handle or (ii) the blunt end protrudes from the handle, wherein the base comprises a pin and the blade has a first hole for receiving the pin when the blade is positioned with the cutting arris protruding from the handle and a second hole for receiving the pin when the blade is positioned with the blunt edge protruding from the handle and wherein the handle further comprises a recess located on the base of the handle shaped to complement the shape, wherein the recess receives the shape when the blade is positioned with the cutting arris protruding from the handle.

21. A plane, comprising:

a. a handle having a longitudinal axis and comprising an upper gripping surface and a base, wherein the base of the handle is stepped and has a sole and a heel;

b. a magnet cup attached to the handle;

c. a magnet positioned in the magnet cup; and d. a blade having a top face, a bottom face, a sharp end comprising a cutting arris, and a blunt end, wherein the blade is attachable to the handle with the magnet so that the cutting arris is transverse to the longitudinal axis of the handle and alternatively (i) the cutting arris protrudes from the handle or (ii) the blunt end protrudes from the handle, wherein the top face of the blade rests against the sole of the base and the blunt end of the blade abuts the heel of the base when the blade is positioned on the magnet so that the cutting arris protrudes from the handle.

22. The plane of claim 15, wherein the handle further comprises a smooth, bulbous portion for contact during use by a palm of a user's hand.

23. The plane of claim 15, wherein the handle further comprises generally vertical ridges on opposite sides of the handle for contact during use by a user's thumb and fingers.

24. A plane, comprising:

a. a handle having a longitudinal axis and comprising an upper gripping surface and a base, wherein the upper gripping surface comprises a smooth, bulbous portion for contact during use by a palm of a user's hand and generally vertical ridges on opposite sides of the handle for contact during use by the user's thumb and fingers, and the base is stepped and has a sole and a heel, and further comprises a pin and a recess;

b. a magnet cup attached to the base of the handle with at least one screw;

c. a magnet positioned in the magnet cup; and d. a blade comprising a top face, a bottom face, a sharp end comprising a cutting edge, a blunt end comprising a shape that is not straight, and a first hole and a second hole, wherein the blade is attached to the handle with the magnet so that the blade is oriented parallel to the longitudinal axis of the handle and wherein the blade is positionable on the magnet alternatively so that (i) the cutting edge protrudes from the handle or (ii) the blunt end protrudes from the handle, wherein the top face of the blade rests against the sole of the base, the blunt end of the blade abuts the heel of the base, the recess receives the shape of the blunt end, and the first hole receives the pin when the blade is positioned on the magnet so that the cutting edge protrudes from the handle, and the second hole receives the pin when the blade is positioned on the magnet so that the blunt end protrudes from the handle.

* * * * *